United States Patent [19]

Vanier

[11] 4,407,928

[45] Oct. 4, 1983

[54] USE OF KETAL BLOCKED QUINONES TO REDUCE POST-PROCESS $D_{min}$ INCREASE IN POSITIVE REDOX DYE-RELEASING IMAGE TRANSFER SYSTEMS

[75] Inventor: Noel R. Vanier, Rochester, N.Y.

[73] Assignee: Eastman Kodak Company, Rochester, N.Y.

[21] Appl. No.: 392,502

[22] Filed: Jun. 28, 1982

[51] Int. Cl.[3] ..... G03C 1/40; G03C 5/54; G03C 1/10

[52] U.S. Cl. ..... 430/214; 430/212; 430/223; 430/236; 430/242; 430/486; 430/467; 430/955

[58] Field of Search ..... 430/212, 214, 223, 242, 430/486, 955, 236, 467

[56] References Cited

U.S. PATENT DOCUMENTS

| | | | |
|---|---|---|---|
| 3,868,252 | 2/1975 | Campbell et al. | 430/212 |
| 3,928,043 | 12/1975 | Ciurca, Jr. | 430/212 |
| 3,998,640 | 12/1976 | Ciurca et al. | 430/212 |
| 4,046,652 | 9/1977 | Pistorius et al. | 204/78 |
| 4,088,488 | 5/1978 | Chang et al. | 430/212 |
| 4,139,379 | 2/1979 | Chasman et al. | 430/223 |
| 4,139,389 | 2/1979 | Hinshaw et al. | 430/223 |
| 4,160,109 | 7/1979 | Pistorius | 568/667 |
| 4,203,811 | 5/1980 | Cramer | 204/78 |
| 4,353,975 | 10/1982 | Janssens et al. | 430/223 |

FOREIGN PATENT DOCUMENTS

| | | |
|---|---|---|
| 2547383 | 4/1977 | Fed. Rep. of Germany . |
| 2547386 | 4/1977 | Fed. Rep. of Germany . |
| 2547463 | 4/1977 | Fed. Rep. of Germany . |
| 2739315 | 3/1979 | Fed. Rep. of Germany . |

*Primary Examiner*—Richard L. Schilling
*Attorney, Agent, or Firm*—Harold E. Cole

[57] ABSTRACT

Photographic assemblages and processes are described employing positive-working redox dye-releasers and a processing composition containing a ketal blocked quinone which is soluble therein. After processing, when the pH is lowered, the free quinone is released for reaction with residual electron transfer agent present in the assemblage to prevent it from reacting with the dye releaser, which would otherwise cause further dye release. $D_{min}$ stability is thereby improved.

27 Claims, No Drawings

USE OF KETAL BLOCKED QUINONES TO REDUCE POST-PROCESS $D_{min}$ INCREASE IN POSITIVE REDOX DYE-RELEASING IMAGE TRANSFER SYSTEMS This invention relates to photography, and more particularly to photographic assemblages and processes for color diffusion transfer photography employing at least one silver halide emulsion layer and a positive-working redox dye-releaser (PRDR) wherein a processing composition is employed which contains a ketal blocked quinone which is soluble therein. After processing and lowering of the pH of the system, free quinone is released which reacts with residual electron transfer agent present in the assemblage to prevent it from slowly reducing the PRDR which would cause unwanted dye release. Post-process $D_{min}$ stability is thereby achieved in accordance with this invention.

Various formats for color, integral transfer elements are described in the prior art, such as U.S. Pat. Nos. 3,415,644; 3,415,645; 3,415,646; 3,647,437; 3,635,707; 3,756,815, and Canadian Patents 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 to 10 minutes or more in other formats. Since development occurs at a high pH, it is rapidly slowed by merely lowering the pH. The use of a neutralizing layer, such as a polymeric acid, can be employed for this purpose. Such a layer will stabilize the element after silver halide development and the required diffusion of dyes has taken place. A timing layer is usually employed in conjunction with the neutralizing layer, so that the pH is not prematurely lowered, which would prematurely restrict development and dye release. The development time is thus established by the time it takes the alkaline composition to penetrate through the timing layer. As the system starts to become stabilized, alkali is depleted throughout the structure, causing silver halide development to substantially cease in response to this drop in pH. This may also cause the dye release rate to slow down. For each image generating unit, this shutoff mechanism establishes the amount of silver halide development and the related amount of dye released or formed according to the respective exposure values.

In color transfer assemblages employing non-diffusible PRDR's, a dye is released as an inverse function of development, i.e., dye is released by some mechanism in the non-exposed areas of the silver halide emulsion. Use of a negative-working silver halide emulsion in such a system will therefore produce a positive image in the image-receiving layer. Examples of such PRDR's are described in U.S. Pat. Nos. 4,139,379 and 4,139,389. The immobile compounds described in these patents are ballasted electron-accepting nucleophilic displacement (BEND) compounds. The BEND compound as incorporated in a photographic element is incapable of releasing a diffusible dye. However, during photographic processing under alkaline conditions, the BEND compound is capable of accepting at least one electron (i.e. being reduced) from an incorporated reducing agent (IRA) and thereafter releases a diffusible dye. This occurs in the unexposed areas of the emulsion layer. In the exposed areas of the emulsion layer, however, an electron transfer agent (ETA) reduces the silver halide and becomes oxidized. The oxidized ETA is then reduced by the IRA, thus preventing the IRA from reacting with the BEND compound. The BEND compound therefore is not substantially reduced and thus no dye is released in the exposed areas.

After processing the photographic element described above, electron transfer agent remains after imaging in both the exposed and nonexposed areas. A problem which occurs is that the $D_{min}$ continues to increase over a period of time. This is sometimes described in the art as "post-process density increase". It is believed that over a period of time, the electron transfer agent can slowly reduce the PRDR and cause this unwanted dye release. In accordance with my invention, I have found a way for lessening the extent of post process density increase in PRDR systems by providing a means to inactivate the electron transfer agent after imaging.

U.S. Pat. No. 4,139,379 of Chasman et al describes PRDR systems in which the present invention can be employed. In Example 2 of Chasman et al, an oxidant is employed in layer 4 of the photographic element as a scavenger. This scavenger prevents the incorporated reducing agent (or electron donor) associated with one of the emulsion layers from reacting in another emulsion layer and thereby reduces any color contamination or "cross-talk" between these layers. A different material is used in my invention in an entirely different location in the assemblage and for an entirely different purpose.

U.S. Pat. Nos. 3,868,252, 3,928,043, 3,998,640 and 4,088,488 relate to the use of certain oxidants which can be used in various image transfer systems. The oxidants are disclosed as being used in either the processing composition or the image-receiving element. Ketal blocked quinones, which are unblocked as a function of pH, are not disclosed in these patents, however. In addition, the dye image-providing materials disclosed in these patents are not PRDR's as described herein.

German Patent Publication Nos. 2,460,754, 2,547,383, 2,547,386, 2,547,463, 2,703,453, 2,739,315 and Belgian Pat. No. 870,162 all relate to ketal blocked quinones. None of these references, however, disclose that ketal blocked quinones would be useful as oxidants in photographic materials.

A photographic assemblage in accordance with my invention comprises:

(a) a photographic element comprising a support having thereon at least one photosensitive silver halide emulsion layer having associated therewith a positive-working, redox dye-releaser;
(b) a dye image-receiving layer;
(c) an alkaline processing composition and means for discharging same within the assemblage, and
(d) a transparent cover sheet located over the layer outermost from the support;

the photographic element or the processing composition containing an electron transfer agent, and wherein the alkaline processing composition contains a ketal blocked quinone which is soluble therein.

In a preferred embodiment of my invention the ketal blocked quinone has the following formula:

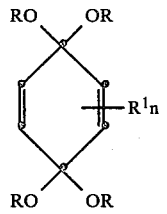

wherein each R independently represents an alkyl group, preferably an alkyl group having from 1 to about 4 carbon atoms, e.g., methyl, ethyl, propyl, isopropyl, butyl or isobutyl; an aryl group, preferably an aryl group having from 6 to about 8 carbon atoms such as phenyl, tolyl or xylyl; or an aralkyl group, preferably an aralkyl group having from 7 to about 9 carbon atoms such as benzyl or phenethyl; or any two R's of the same ketal group may be taken together to form a 5- or 6-membered ring, including rings fused thereto, such as

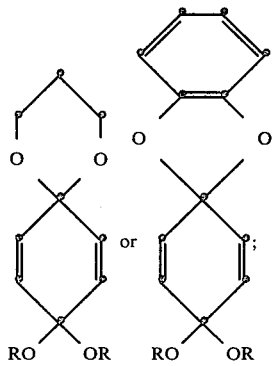

or an R can form a 5- or 6-membered ring with another substituent on the quinone ring, including rings fused thereto, such as

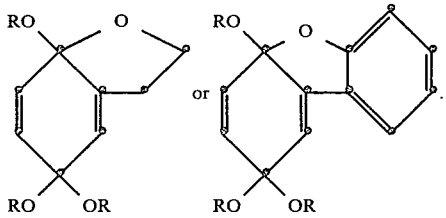

These R groups may also be substituted as long as the substituents do not interfere with the ability of the compound to be diffusible and to form the free quinone after processing. In a preferred embodiment of the invention, each R in the above formula is methyl, the compound thus being quinone bis(dimethyl ketal).

The ketal blocked quinones illustrated above may also have one or more substituents thereon ($R^1$) as long as they do not prevent the compound from being soluble in the processing compositon. Such substituents could include, for example, alkyl, aryl, alkenyl, alkoxy, aryloxy, halogens, alkylthio, arylthio, hydrolyzable ester groups, carboxymethyl groups, and solubilizing groups such as carboxylic or sulfonic acid groups. In the above formula, n can be an integer of from 0 to 4.

In another preferred embodiment of the invention, each R in the above formula is methyl, the compound has a methoxycarbonylpropyl group in the 2-position and an isopropyl group in the 5-position.

Before and during processing at high pH, the ketal blocked quinone in the processing composition is stable and does not prematurely react with the electron transfer agent. In this form, the ketal blocked quinone may be thought of as an oxidant precursor. As the pH is lowered by the shut-down mechanism in the film assemblage after imaging has occurred, the free quinone is then released for reaction with the residual electron transfer agent. A free quinone or other oxidant cannot be directly admixed with an ETA in the processing composition, since it would react prematurely resulting in severe image degradation. As discussed above, inactivation of the residual electron transfer agent is believed to be a major factor in obtaining post-process $D_{min}$ stability.

The ketal blocked quinones useful in my invention may be prepared electrochemically by any of the methods described in *Organic Syntheses* 57, 92 (1977) or in German Patent publication Nos. 2,460,754, 2,547,383, 2,547,386, 2,547,463, 2,703,453, 2,739,315 and Belgian Pat. No. 870,162, the disclosures of which are hereby incorporated by reference. In general, the process involves an anodic oxidation of benzene substituted in the o- or m-position by a lower alkyl group or a halogen. The process takes place in methyl alcohol, water, an electrolyte of a conductive salt, and a difficult-to-oxidize base, at a pH $>7$ at 20° to 60° C. The anode consists of graphite, a platinum metal or alloy or $PbO_2$.

The ketal blocked quinones employed in my invention may be present in the alkaline processing composition in any concentration which is effective for the intended purpose. In general, good results are obtained at concentrations ranging from about 0.5 to about 50 grams per liter of processing composition, preferably 2.5 to 25 grams per liter.

Any PRDR's known in the art may be employed in this invention. Such PRDR's are disclosed, for example, in U.S. Pat. Nos. 4,139,379, 4,199,354, 4,232,107, 4,242,435, 4,273,855, 3,980,479 and 4,139,389, the disclosures of which are hereby incorporated by reference. In a preferred embodiment of this invention, the PRDR is a quinone PRDR and the photographic element contains an incorporated reducing agent as described in U.S. Pat. No. 4,139,379, referred to above. In another preferred embodiment, the quinone PRDR's have the formula:

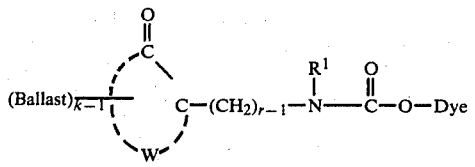

wherein:

Ballast is an organic ballasting radical of such molecular size and configuration as to render the compound nondiffusible in the photographic element during development in an alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is an organic dye or dye precursor moiety.

In a preferred embodiment of the invention, the silver halide emulsions employed are the conventional, negative-working emulsions well known to those skilled in the art. A positive image will thereby be obtained in the image-receiving layer. Use of a direct-positive emulsion will produce a negative image in the image-receiving layer. Such a negative can be used to produce positive prints if so desired.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of the invention, the dye image-receiving element would comprise a support having thereon, in sequence, a neutralizing layer, a timing layer and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the above-described film assemblage is located integral with the photographic element and is located between the support and the lowermost photosensitive silver halide emulsion layer. One useful format for integral imaging receiver photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral imaging receiver photographic elements in which the present invention is employed is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition including an ETA and an opacifier, is positioned between the top layer and a transparent cover sheet which has thereon, in sequence, a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photo-sensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a dye image-providing material. A dye image-receiving layer would be provided on a second support with the processing composition being applied therebetween. This format could either be peel-apart or integral, as described above.

A process for producing a photographic transfer image in color according to the invention from an imagewise exposed photosensitive element comprising a support having thereon at least one photosensitive silver halide emulsion layer having associated therewith a dye image-providing material as described above comprises treating the element with an alkaline processing composition in the presence of a silver halide developing agent or ETA to effect development of each of the exposed silver halide emulsion layers. An imagewise distribution of dye image-providing material is thus formed as a function of development, and at least a portion of it diffuses to a dye image-receiving layer to provide the transfer image. The electron transfer agent remaining in the photosensitive element after development is then oxidized by means of an oxidant comprising a quinone which is released from a ketone blocked quinone initially present in the processing composition, as described above, to prevent it from further reaction with the PRDR which would otherwise cause additional dye release over a period of time.

The film unit or assemblage of the present invention is used to produce positive images in single or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive, i.e., the blue-sensitive silver halide emulsion layer will have a yellow dye-releaser associated therewith, the green-sensitive silver halide emulsion layer will have a magenta dye-releaser associated therewith and the red-sensitive silver halide emulsion layer will have a cyan dye-releaser associated therewith. The dye-releaser associated with each silver halide emulsion layer is contained either in the silver halide emulsion layer itself or in a layer contiguous to the silver halide emulsion layer, i.e., the dye-releaser can be coated in a separate layer underneath the silver halide emulsion layer with respect to the exposure direction.

The concentration of the dye-releasing compounds that are employed in the present invention can be varied over a wide range, depending upon the particular compound employed and the results desired. For example, a dye-releaser coated in a layer at a concentration of 0.1 to 3 g/m$^2$ has been found to be useful. The dye-releaser can be dispersed in a hydrophilic film-forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; phenylenediamine compounds, such as or N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid-and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed together with the dye releaser in gelatin or another aqueous alkaline solution-permeable polymeric binder and are about 0.6 to 7 microns in thickness; and the alkaline solution-permeable polymeric interlayers, e.g., gelatin, are about 0.2 to 5 microns in thickness. Of course, these thicknesses are approximate only and can be modified according to the product desired. The silver halide emulsions and dye releasers may also be coated in separate layers, if desired.

Scavengers for oxidized developing agents can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a neutralizing material in the film assemblages of this invention will usually increase the stability of the transferred image. Generally, the neutralizing material will effect a reduction in the pH of the image layer from about 13 or 14 to at least 11 and preferably 5 to 8 within a short time after treatment with alkali. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, the composition containing a ketal blocked quinone as described above, and also preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of three primary regions of the spectrum can be disposed as a single segmented layer, e.g., as by the use of microvessels as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above articles; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Photographic Test—Ketal Blocked Quinone

A cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$); and (2) a timing layer comprising a 1:1 physical mixture of the following two polymers coated at 4.8 g/$m^2$:

(a) poly(acrylonitrile-co-vinylidene chloride-co-acrylic acid) (wt. ratio 14:79:7), and (b) a lactone polymer, partially hydrolyzed and 1-butanol transesterified poly(vinyl acetate-co-maleic anhydride) (ratio of acid/butyl ester 15:85).

An integral imaging-receiver (IIR) element was prepared by coating the following layers in the order recited on a transparent poly(ethylene terephthalate) film support. Quantities are parenthetically given in grams per square meter, unless otherwise stated.

(1) metal containing layer of nickel sulfate .$6H_2O$ (0.58) and gelatin (1.1);

(2) image-receiving layer of poly(4-vinylpyridine) (2.2) and gelatin (2.2);

(3) reflecting layer of titanium dioxide (16.0) and gelatin (2.6);

(4) opaque layer of carbon black (1.9) and gelatin (1.2);

(5) interlayer of gelatin (1.2);

(6) blue-sensitive, negative-working silver bromoiodide emulsion (1.4 silver), gelatin (2.2), yellow PRDR (0.45), incorporated reducing agent IRA (0.44), and inhibitor (0.02); and (7) overcoat layer of gelatin (0.54).

YELLOW PRDR

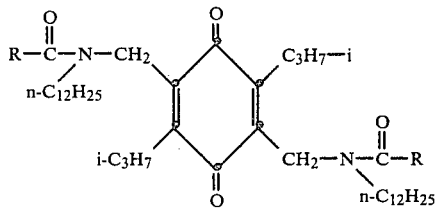

Where R =

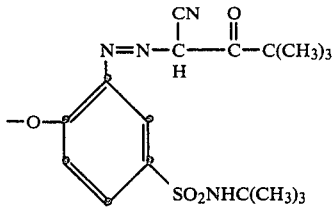

Dispersed in di-n-butyl phthalate (Total solid:solvent 1:1).

IRA

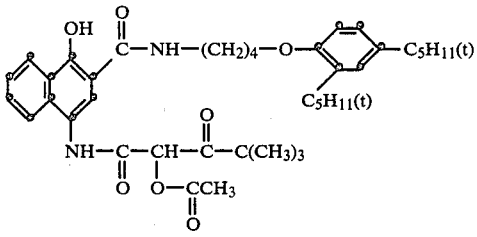

Dispersed in di-n-butyl phthalate (Total solid:solvent 1:1).

INHIBITOR

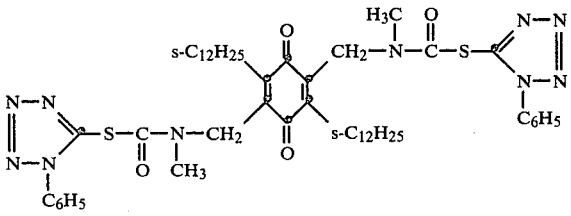

Dispersed in di-n-butyl phthalate (Total solid:solvent 1:1).

Pods containing the following processing composition were prepared:

| | Pod Composition (g/l) | |
|---|---|---|
| | Control | Experiment |
| Potassium hydroxide | 51.0 | 51.0 |

-continued

| | Pod Composition (g/l) | |
|---|---|---|
| | Control | Experiment |
| 4-hydroxymethyl-4-methyl-1-p-tolyl-3-pyrazolidinone (ETA) | 8.0 | 8.0 |
| Potassium bromide | 5.0 | 5.0 |
| Sodium sulfite | 2.0 | 2.0 |
| Carboxymethyl cellulose | 40.0 | 40.0 |
| Quinone bis(dimethyl ketal) | — | 10.0 |
| Water to 1 liter | | |

Samples of the yellow IIR were exposed in a sensitometer to yield a full-scale $D_{max}-D_{min}$ image after processing with the above viscous processing compositions in a pod. The exposed samples were processed by rupturing a pod containing the viscous processing compositions described above between the IIR and the cover sheet described above by using a pair of juxtaposed rollers. Within 3 hours, the laminate was cut in half and the two parts of one half of the laminate were separated and the Status A blue density of the receiver side of the IIR was read to give "fresh" $D_{max}-D_{min}$ data. After 48 hours incubation at 60° C./70 percent RH, the integral half of the sample was kept for 16 months at room temperature and the $D_{max}$ and $D_{min}$ were read again. The following results were obtained:

| Processing Composition | Fresh | | Status A Blue Density After Keeping | | |
|---|---|---|---|---|---|
| | $D_{max}$ | $D_{min}$ | $D_{max}$ | $D_{min}$ | $\Delta D_{min}$ |
| Control | 1.4 | 0.29 | 1.5 | 0.92 | +0.63 |
| Experiment [w/quinone bis (dimethyl ketal)] | 1.4 | 0.33 | 1.5 | 0.60 | +0.27 |

The above data indicated that use of a ketal blocked quinone in the processing composition gives improved post-process $D_{min}$ stability.

EXAMPLE 2

Photographic Test —Substituted Ketal Blocked Quinone

An integral imaging-receiver (IIR) element was prepared by coating the following layers in the order recited on a transparent poly(ethylene terephthalate) film support. Quantities are parenthetically given in grams per square meter, unless otherwise stated.

(1) metal containing layer of nickel sulfate .$6H_2O$ (0.58) and gelatin (1.1);

(2) image-receiving layer of poly(4-vinylpyridine) (2.2) and gelatin (2.2);

(3) reflecting layer of titanium dioxide (16) and gelatin (2.6);

(4) opaque layer of carbon black (1.9) and gelatin (1.2);

(5) interlayer of gelatin (2.5);

(6) red-sensitive, negative-working silver bromoiodide emulsion (1.4 silver), gelatin (2.2), cyan PRDR (0.55), incorporated reducing agent IRA (0.32), and inhibitor (0.02); and (7) overcoat of gelatin (1.0)

CYAN PRDR

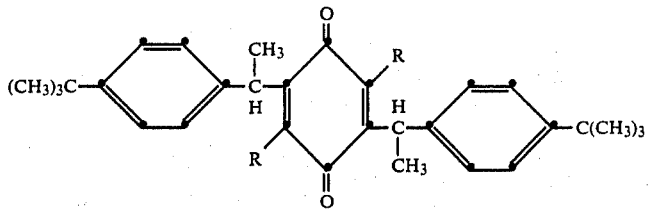

Where R =

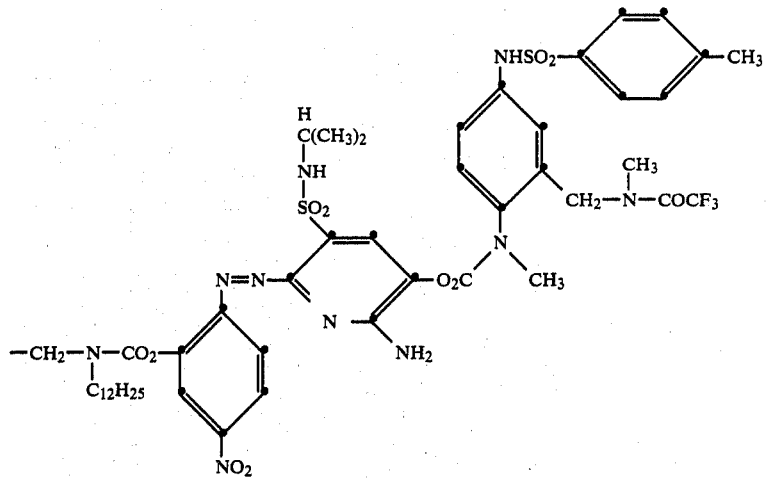

Dispersed in diethyllauramide (PRDR:solvent 1:1).

A cover sheet equivalent to that of Example 1 was prepared.

Pods containing the following processing composition were prepared.

| | Pod Composition (g/l) | |
|---|---|---|
| | Control | Experiment |
| Potassium hydroxide | 51.0 | 51.0 |
| 4-hydroxymethyl-4-methyl-p-tolyl-3-pyrazolidinone (ETA) | 4.0 | 4.0 |
| Potassium bromide | 10.0 | 10.0 |
| Sodium sulfite | 2.0 | 2.0 |
| Carboxymethyl cellulose | 57.0 | 57.0 |
| Substituted ketal blocked quinone (see below) | — | 20.0 |
| Water to 1 liter | | |

Substituted ketal blocked quinone

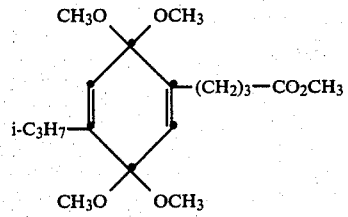

Processing was the same as in Example 1 except that the incubation was for 48 hours at 60° C./70 percent RH, after which the density was read. The following results were obtained.

| Processing Composition | Fresh | | Status A Red Density After Keeping | | |
|---|---|---|---|---|---|
| | $D_{max}$ | $D_{min}$ | $D_{max}$ | $D_{min}$ | $\Delta D_{min}$ |
| Control | 2.2 | 0.23 | 2.6 | 1.1 | +0.85 |
| Experiment (w/substituted ketal blocked quinone) | 2.2 | 0.26 | 2.6 | 0.56 | +0.30 |

The above data indicate that use of a substituted ketal blocked quinone in the processing composition also gives improved post-process $D_{min}$ stability. The alkyl ester group in the 2-position is believed to rapidly hydrolyze to the free acid (salt) providing for improved solubility.

The invention has been described in detail with particular reference to preferred embodiments thereof, but it will be understood that variations and modifications can be effected within the spirit and scope of the invention.

What is claimed is:

1. In a photographic assemblage comprising:

(a) a photographic element comprising a support having thereon at least one photosensitive silver halide emulsion layer having associated therewith a nondiffusible, positive-working, redox dye-releaser capable of releasing a diffusible dye upon reduction;

(b) a dye image-receiving layer;

(c) an alkaline processing composition and means for discharging same within said assemblage; and (d) a transparent cover sheet located over the layer outermost from said support; said photographic element or said processing composition containing an electron transfer agent, said photographic element or said cover sheet containing a neutralizing layer;

the improvement wherein said alkaline processing composition contains a ketal blocked quinone which is soluble therein.

2. The photographic assemblage of claim 1 wherein said ketal blocked quinone has the formula

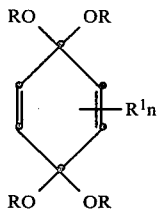

wherein (a) each R independently represents an alkyl, aryl or aralkyl, or any two R's on the same ketal group may be taken together to form a 5- or 6-membered ring, or an R can form a 5- or 6-membered ring with another substituent on the quinone ring;

(b) each $R^1$ independently represents an alkyl, aryl, alkenyl, alkoxy, aryloxy, halogen, alkylthio, arylthio, hydrolyzable ester, carboxymethyl or solubilizing group; and (c) n is 0–4.

3. The photographic assemblage of claim 2 wherein each R is methyl and n is 0.

4. The photographic assemblage of claim 3 wherein said ketal blocked quinone has a methoxycarbonylpropyl group in the 2-position and an isopropyl group in the 5-position.

5. The photographic assemblage of claim 1 wherein said ketal blocked quinone is present at a concentration of from about 0.5 to about 50 g/liter of composition.

6. The assemblage of claim 1 wherein said positive-working redox dye-releaser is a quinone redox dye-releaser and said photographic element contains an incorporated reducing agent.

7. The assemblage of claim 6 wherein said quinone redox dye-releaser has the formula:

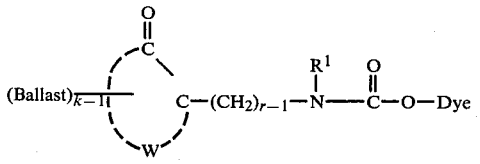

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is an organic dye or dye precursor moiety.

8. The assemblage of claim 1 wherein said cover sheet is coated with, in sequence, a neutralizing layer and said timing layer.

9. The assemblage of claim 1 wherein said dye image-receiving layer is located between said support and said silver halide emulsion layer.

10. The assemblage of claim 9 wherein said transparent cover sheet is coated with, in sequence, said neutralizing layer and a timing layer.

11. The assemblage of claim 10 wherein said discharging means is a rupturable container containing said alkaline processing composition and an opacifying agent, said container being so positioned during processing of said assemblage that a compressive force applied to said container will effect a discharge of the container's contents between said cover sheet and the layer outermost from said support.

12. The assemblage of claim 1 wherein said support having thereon said silver halide emulsion layer is opaque, and said dye image-receiving layer is located on said transparent cover sheet and is a dye image-receiving element.

13. The assemblage of claim 12 wherein said dye image-receiving element has thereon, in sequence, said neutralizing layer, a timing layer, and said dye image-receiving layer.

14. The assemblage of claim 12 wherein said opaque support has thereon, in sequence, said neutralizing layer, a timing layer and said silver halide emulsion layer.

15. The assemblage of claim 1 wherein said photographic element comprises a support having thereon a red-sensitive, negative-working, silver halide emulsion layer having a nondiffusible, positive-working, redox cyan dye-releaser associated therewith capable of releasing a diffusible cyan dye upon reduction; a green-sensitive, negative-working, silver halide emulsion layer having a nondiffusible, positive-working, redox magenta dye-releaser associated therewith capable of releasing a diffusible magenta dye upon reduction; and a blue-sensitive, negative-working, silver halide emulsion layer having a nondiffusible, positive-working, redox yellow dye-releaser associated therewith capable of releasing a diffusible yellow dye upon reduction.

16. In an integral photographic assemblage comprising:

(a) a photographic element comprising a transparent support having thereon the following layers in sequence: a dye image-receiving layer; an alkaline solution-permeable, light-reflective layer; an alkaline solution-permeable, opaque layer; a red-sensitive, negative-working, silver halide emulsion layer having a nondiffusible, positive-working, redox cyan dye-releaser associated therewith capable of releasing a diffusible cyan dye upon reduction; a green-sensitive, negative-working, silver halide emulsion layer having a nondiffusible, positive-working, redox magenta dye-releaser associated therewith capable of releasing a diffusible magenta dye upon reduction; and a blue-sensitive, negative-working, silver halide emulsion layer having a nondiffusible, positive-working, redox yellow dye-releaser associated therewith capable of releasing a diffusible yellow dye upon reduction;

(b) a transparent cover sheet superposed over said blue-sensitive silver halide emulsion layer and comprising a transparent support coated with, in sequence, a neutralizing layer and a timing layer; and (c) a rupturable container containing an alkaline processing composition including an electron transfer agent and an opacifying agent, said container being so positioned during processing of said assemblage that a compressive force applied to said container will effect a discharge of the container's contents between said transparent sheet and said blue-sensitive silver halide emulsion layer;

the improvement wherein said alkaline processing composition contains a ketal blocked quinone which is soluble therein.

17. The photographic assemblage of claim 16 wherein said ketal blocked quinone has the formula

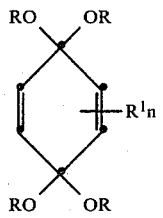

wherein (a) each R independently represents an alkyl, aryl or aralkyl, or any two R's on the same ketal group may be taken together to form a 5- or 6-membered ring, or an R can form a 5- or 6-membered ring with another substituent on the quinone ring;

(b) each $R^1$ independently represents an alkyl, aryl, alkenyl, alkoxy, aryloxy, halogen, alkylthio, arylthio, hydrolyzable ester, carboxymethyl or solubilizing group; and (c) n is 0–4.

18. The photographic assemblage of claim 17 wherein each R is methyl and n is 0.

19. The photographic assemblage of claim 18 wherein said ketal blocked quinone has a methoxycarbonylpropyl group in the 2-position and an isopropyl group in the 5-position.

20. The photographic assemblage of claim 16 wherein said ketal blocked quinone is present at a concentration of from about 0.5 to about 50 g/liter of composition.

21. The assemblage of claim 16 wherein each said positive-working redox dye-releaser is a quinone redox dye-releaser and said photographic element contains an incorporated reducing agent.

22. The assemblage of claim 21 wherein said quinone redox dye-releaser has the formula:

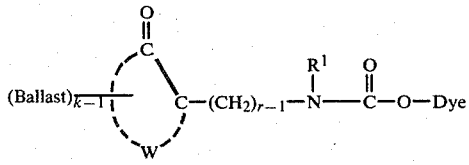

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is an organic dye or dye precursor moiety.

23. In a process for producing a photographic transfer image in color from an imagewise-exposed photosensitive element comprising a support having thereon at least one photosensitive silver halide emulsion layer having associated therewith a dye image-providing material comprising a nondiffusible, positive-working redox dye-releaser capable of releasing a diffusible dye upon reduction, said process comprising treating said element with an alkaline processing composition in the presence of an electron transfer agent to effect development of each of said exposed silver halide emulsion layers, whereby an imagewise distribution of dye image-providing material is formed as a function of development and at least a portion of it diffuses to a dye image-receiving layer to provide said transfer image, the improvement comprising oxidizing said electron transfer agent remaining in said photosensitive element after development by means of an oxidant to prevent said electron transfer agent from further reaction with said positive-working redox dye-releaser which would otherwise cause additional dye release over a period of time, said oxidant comprising a quinone which is released by pH reduction from a ketal blocked quinone initially present in said processing composition and which is soluble therein.

24. The process of claim 24 wherein said ketal blocked quinone has the formula

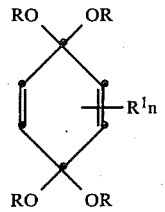

wherein (a) each R independently represents an alkyl, aryl or aralkyl, or any two R's on the same ketal group may be taken together to form a 5- or 6-membered ring, or an R can form a 5- or 6-membered ring with another substituent on the quinone ring;

(b) each $R^1$ independently represents an alkyl, aryl, alkenyl, alkoxy, aryloxy, halogen, alkylthio, arylthio, hydrolyzable ester, carboxymethyl or solubilizing group; and (c) n is 0–4.

25. The process of claim 24 wherein each R is methyl and n is 0.

26. The process of claim 25 wherein said ketal blocked quinone has a methoxycarbonylpropyl group in the 2-position and an isopropyl group in the 5-position.

27. The process of claim 23 wherein said ketal blocked quinone is present at a concentration of from about 0.5 to about 50 g/liter of composition.

* * * * *